US007000791B2

(12) United States Patent
Miller

(10) Patent No.: US 7,000,791 B2
(45) Date of Patent: Feb. 21, 2006

(54) VIAL CLOSURE WITH INDICATOR

(76) Inventor: Mark H. Miller, P.O. Box 185, Hope, RI (US) 02831

( * ) Notice: Subject to any disclaimer, the term of this patent is extended or adjusted under 35 U.S.C. 154(b) by 26 days.

(21) Appl. No.: 10/715,102

(22) Filed: Nov. 17, 2003

(65) Prior Publication Data

US 2004/0144677 A1 Jul. 29, 2004

Related U.S. Application Data

(60) Provisional application No. 60/426,968, filed on Nov. 18, 2002.

(51) Int. Cl.
*B65D 55/02* (2006.01)

(52) U.S. Cl. ..... 215/230; 215/203; 206/534

(58) Field of Classification Search ..... 206/534, 206/459.5, 459.1, 459.5 X, 459.1 X; 116/306, 116/308, 309; 215/203 X, 230 X
See application file for complete search history.

(56) References Cited

U.S. PATENT DOCUMENTS

| | | | | | |
|---|---|---|---|---|---|
| 3,232,401 | A | * | 2/1966 | Jones | 400/134 |
| 3,621,811 | A | * | 11/1971 | Hill, Jr. | 116/292 |
| 4,011,829 | A | * | 3/1977 | Wachsmann et al. | 116/308 |
| 4,041,628 | A | * | 8/1977 | Sasson | 40/111 |
| 4,749,093 | A | * | 6/1988 | Trick | 215/220 |
| 4,756,423 | A | * | 7/1988 | Holtsch | 206/534 |
| 4,920,912 | A | * | 5/1990 | Kirkling | 116/308 |
| 5,720,392 | A | * | 2/1998 | Price | 206/534 |
| 5,984,122 | A | * | 11/1999 | Barker et al. | 215/230 |
| 6,059,133 | A | * | 5/2000 | Lai | 215/230 |

* cited by examiner

*Primary Examiner*—Mickey Yu
*Assistant Examiner*—Jerrold Johnson

(57) ABSTRACT

A closure for medicine vials, comprising a cap and a rotatable detented indicator arranged to indicate the last pill or medicine dose taken. The indicator may be transparent with numbers that are rendered visible by contrast with the cap color. The indicator may use 12 detented positions, a number evenly divisible by the common prescription quantities of 2, 3, 4, and 6 per day.

14 Claims, 3 Drawing Sheets

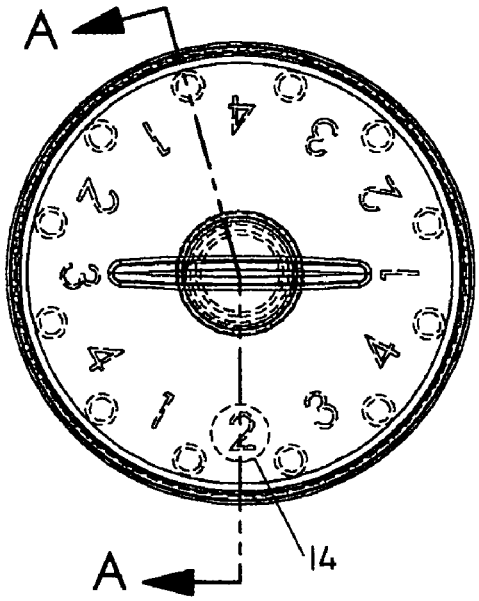
FIG. IB
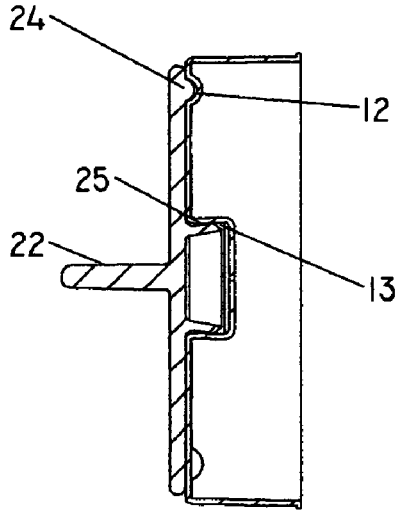
FIG. IC
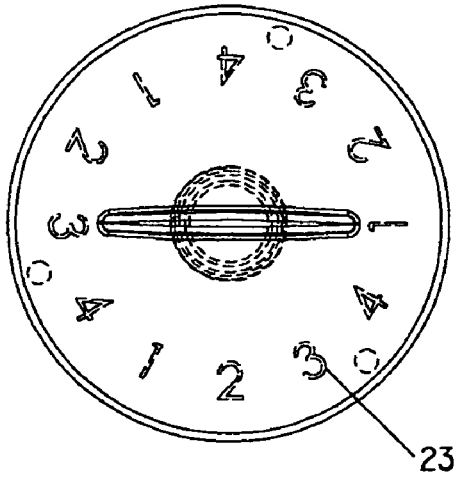
FIG. ID

VIAL CLOSURE WITH INDICATOR

This application claims the benefit of Provisional Application No. 60/426,968, filed Nov. 18, 2002.

BACKGROUND

1. Field of Invention

This invention relates to vial closures, specifically to such closures which are used for vials containing medicinal pills.

2. Description of Prior Art

Pharmacies commonly dispense prescription medications in the form of pills. These pills are typically packaged in vials; that is, containers that are sealed with a closure. Two common types of closures are the simple snap-fit type, which is not resistant to opening by a child, and the "child-resistant" type, of which there are several different designs in use.

Ordinarily, prescription medication must be taken at more-or-less regular intervals. Failure to do so can result in ineffective treatment or other serious consequences, such as an overdose. Consequently, it is important for patients to not forget the number of pills they have taken.

It is well known in the art to incorporate some type of indicator into

In recent years there has been a number of patents granted for electronic timers with alarms that have been incorporated into closures. These devices all suffer from higher cost and greater complexity than simple mechanical solutions.

Mechanical devices in the prior art that incorporate indicators into closures invariably indicate time. The indicator in such devices would be set to the next time to take a pill, for example. U.S. Pat. No. 5,279,422 to Adams this type of indicator. As it turns out, the vast majority of prescriptions for pills are written for 2, 3, 4, or 6 pills per day to be taken. Thus, it is really only necessary for a person to be reminded of how many pills they have already taken that day; this is far more useful than a time indication of when to take the next pill, or when the last pill was taken, especially because most people are probably not extremely precise about the time when a pill is taken.

Moreover, the devices shown in the prior art lack the necessary simplicity and low cost to be incorporated into the inexpensive packaging that is used for common prescriptions. Or, they lack the ability to be easily adapted for both the simple snap-fit type and child-resistant type of caps.

OBJECTS OF THE INVENTION

Accordingly, it is the principal object of the present invention to provide an improved pill vial closure having a counter indicator to identify the number of pills previously taken within the day.

It is a further object of the present invention to provide an improved pill vial closure having a counter indicator that is easy to set by an elderly person or someone with visual or motor skills impairment.

It is a further object of the present invention to provide an improved pill vial closure having a counter indicator that is readily adaptable to both snap-fit closures and child-resistant closures.

It is a further object of the present invention to provide an improved pill vial closure having a counter indicator that is very low in cost to manufacture.

DRAWING FIGURES

In the drawings, closely related figures have the same number but different alphanumeric suffixes.

FIG. 1B shows the plan view of FIG. 1A

FIG. 1C shows a rotated section view about A—A in FIG. 1B.

FIG. 1D shows a plan detail of the indicator portion of FIG. 1A.

DETAILED DESCRIPTION OF THE PREFERRED EMBODIMENTS

Figure 1A:
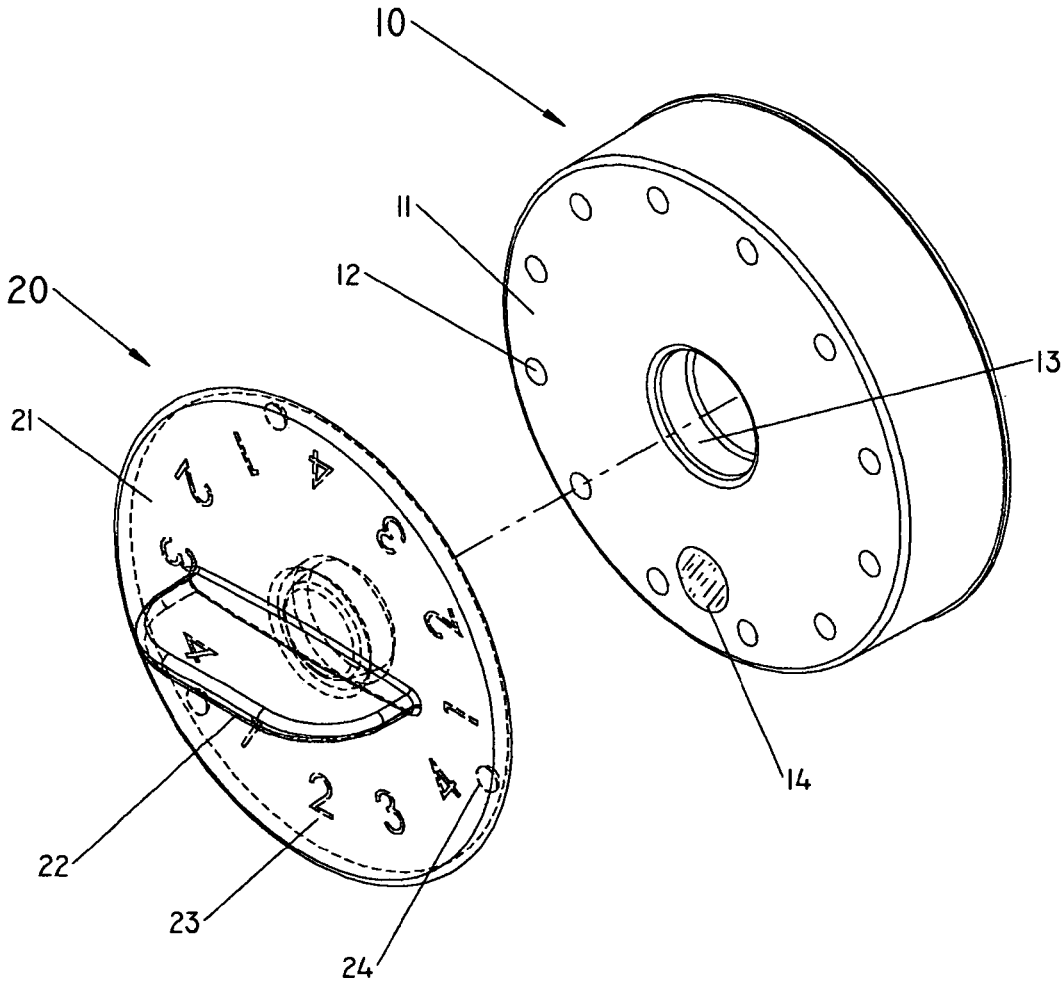
FIG. 1A shows an exploded view of the preferred embodiment of the improved closure with indicator.
Figure 2:
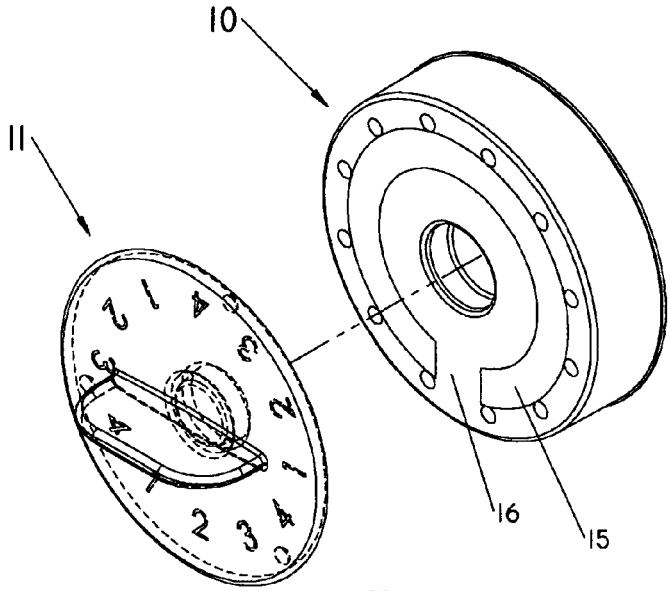
FIG. 2 shows a second embodiment of the improved closure.
Figure 3:
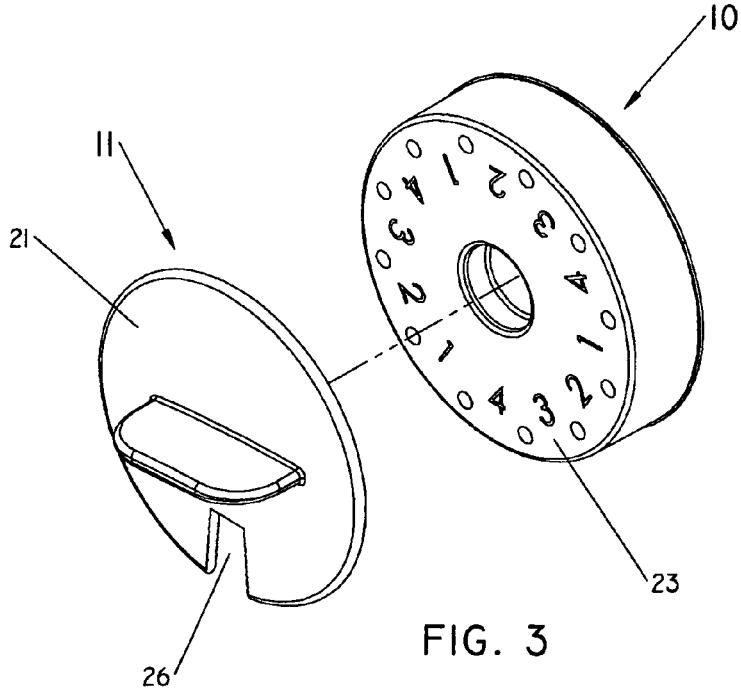
FIG. 3 shows a third embodiment of the improved closure.

FIGS. 1, 2, and 3 show the preferred embodiments of a closure with indication means for medicine vials, consisting of two parts: the cap 10 cap 10. The cap 10 is attached to the vial (not shown) by any means known in the art, such as a snap-fit, thread, or child-proof locking means. Cap 10 is a hollow, short cylinder, closed by face 11. Said face has a plurality of equally spaced detents 12 to engage bosses 24 of indicator 20. Face 11 is further provided with a concentrically located cavity 13 to engage annulus 25 of the indicator, to secure the indicator to the cap, while allowing for free rotation. The indicator, in the preferred embodiment of FIG. 1, is made of a transparent material for viewing the indicia 23 printed on the inner face of the indicator. The indicia are printed in the same color as the cap 10, so that they are invisible for lack of contrast when the indicator is mounted to the cap. However, one of the indicia will aligned with the contrasting colored region 14 on the cap, and will therefore be visible through the transparent indicator. The indicator is provided with a projecting means 22 for grasping and turning the indictor relative to the cap. Obviously, as the indicator is turned, the detents will releasably disengage and then re-engage with the bosses of the indicator, thereby placing each indicia, in turn, in alignment with the contrasting colored region of the cap for viewing. The flexing action of the indicator and the cap allow the indicator to overcome the resistance of the detent when sufficient torque is applied to it.

In the second embodiment of the improved closure, cap 10 is printed with contrasting colored region 14 that underlies all the indicia of indicator 11 except for an opening 16 so shaped as to aligned with a single indicia on the indicator. In this embodiment, the indicia are printed in the same color as the contrasting colored region, and are therefore invisible except when aligned with the opening 16 on the cap.

In the third embodiment of the improved closure, cap 10 is imprinted with the indicia, and the indicator 11 is made of an opaque material and provided with an aperture 26 for viewing a single indicia when it aligns with said aperture.

It is obvious from the above description that any of the three embodiments described would be adaptable to snap-type or child-proof versions of vial closures, and could be so constructed as to not impair the operation of either.

The present invention provides 12 indicia spaced around a circle near the rim of the indicator. For 2 pills per day prescriptions, the numbers will be 1-2-1-2-1-2-1-2-1-2-1-2. For 4 pills per days prescriptions, the numbers will be 1-2-3-4-1-2-3-4-1-2-3-4, and so forth. Twelve indicia divide evenly for prescriptions of 2, 3, 4, and 6 pills per day, which represents the vast majority of all prescriptions. In the preferred embodiment, the numbers are printed on the underside of the dial, in reverse, so that they appear correct when viewed through the transparent dial. An advantage of the embodiments of FIGS. 1 and 2 is that they allow pharmacists to stock a minimum number of different components; they will need only 4 differently printed indicators (for the number of pills per day), all of the same size, and indicator will fit any size cap, since the engaging features on the cap and indicator will have the same dimensions, regardless of cap size.

Although the above description includes many specificities, these should not limit the scope of the invention. For example, there are multitudinous ways in which the snap connection between indicator and cap, and the detents could be accomplished.

I claim:

1. A closure for a pill vial comprising:

a closure body configured and arranged to be removably mounted on a pill vial, said closure body including a top surface;

a transparent indicator dial rotatably secured to the top surface of the closure body, whereby said indicator dial is rotatably movable relative to said closure body;

said indicator dial and said closure body including a plurality of circumferentially spaced mating indexing formations that cooperate to define a plurality of fixed rotational positions of said indicator dial relative to said closure body;

a plurality of circumferentially spaced, sequentially increasing indicia of a first color representing a sequentially increasing number of doses of medicine taken during a predetermined time period, said indicia being located on said indicator dial;

an indicator element of a second color located on said top surface of said closure body, said closure body top surface, in its entirety, being of substantially the same color as the indicia with the exception of the indicator element;

said indicia and said indicator element being circumferentially aligned with said mating indexing formations such that indexing said indicator dial one rotational position advances said indicator element one sequential indicia to indicate one additional dose taken within said predetermined time period.

2. The closure of claim 1, wherein said indicia comprises a repeating pattern of at least two indicia.

3. The closure of claim 1, wherein said indicia comprises three repeating patterns of 4 sequentially increasing indicia.

4. The closure of claim 1, wherein said indicator element comprises an annular band having an open space sufficient to view a single indicia.

5. The closure of claim 1, wherein said indicator clement is a spot.

6. The closure of claim 1, wherein said first color is contrasting to said second color.

7. The closure of claim 1, wherein said plurality of fixed rotational positions is twelve.

8. The closure of claim 1, wherein the indicator dial is selectively detachable from said closure body.

9. A closure for a pill vial comprising:

a closure body configured and arranged to be removably mounted on a pill vial, said closure body including a top surface;

a transparent indicator dial rotatably secured to the top surface of the closure body, whereby said indicator dial is rotatably movable relative to said closure body;

said indicator dial and said closure body including a plurality of circumferentially spaced mating indexing formations that cooperate to define a plurality of fixed rotational positions of said indicator dial relative to said closure body;

a plurality of circumferentially spaced, sequentially increasing indicia of a first color representing a sequentially increasing number of doses of medicine taken during a predetermined time period, said indicia being located on said indicator dial;

said closure body top surface being entirely of a second color with the exception of a annular band having a width at least equal to a height of the indicia, said annular band being interrupted by a gap of a size larger than the indicia, the annular band being of substantially the same color as the indicia, the gap forming an indicator element;

said indicia and said indicator element being circumferentially aligned with said mating indexing formations such that indexing said indicator dial one rotational position advances said indicator element one sequential indicia to indicate one additional dose taken within said predetermined time period.

10. The closure of claim 9, wherein said indicia comprises a repeating pattern of at least two indicia.

11. The closure of claim 9, wherein said indicia comprises three repeating patterns of 4 sequentially increasing indicia.

12. The closure of claim 9, wherein said first color is contrasting to said second color.

13. The closure of claim 9, wherein said plurality of fixed rotational positions is twelve.

14. The closure of claim 9, wherein the indicator dial is selectively detachable from said closure body.

* * * * *